US010830016B2

(12) United States Patent
Kanstad et al.

(10) Patent No.: US 10,830,016 B2
(45) Date of Patent: Nov. 10, 2020

(54) REGULATING THE TEMPERATURE OF A SUBSEA PROCESS FLOW

(71) Applicant: OneSubsea IP UK Limited, London (GB)

(72) Inventors: Stig Kaare Kanstad, Bergen (NO); Nils-Egil Kangas, Radal (NO)

(73) Assignee: OneSubsea IP UK Limited, London (GB)

( * ) Notice: Subject to any disclaimer, the term of this patent is extended or adjusted under 35 U.S.C. 154(b) by 236 days.

(21) Appl. No.: 15/787,186

(22) Filed: Oct. 18, 2017

(65) Prior Publication Data

US 2018/0106131 A1 Apr. 19, 2018

Related U.S. Application Data

(60) Provisional application No. 62/410,144, filed on Oct. 19, 2016.

(51) Int. Cl.

| | |
|---|---|
| ***E21B 36/00*** | (2006.01) |
| ***E21B 43/01*** | (2006.01) |
| ***E21B 43/12*** | (2006.01) |
| ***F28D 1/02*** | (2006.01) |
| ***E21B 43/017*** | (2006.01) |
| ***E21B 41/00*** | (2006.01) |

(52) U.S. Cl.

CPC ..... *E21B 36/001* (2013.01); *E21B 41/0007* (2013.01); *E21B 43/01* (2013.01); *E21B 43/017* (2013.01); *E21B 43/12* (2013.01); *F28D 1/022* (2013.01)

(58) Field of Classification Search

CPC ..... E21B 36/001; E21B 43/01; E21B 43/017; E21B 41/0007; E21B 43/12; F28D 1/022

See application file for complete search history.

(56) References Cited

U.S. PATENT DOCUMENTS

| | | | | |
|---|---|---|---|---|
| 4,112,687 | A | 9/1978 | Dixon | |
| 9,303,491 | B2 | 4/2016 | Kanstad et al. | |
| 2012/0097362 | A1* | 4/2012 | Kanstad | E21B 36/001 165/45 |
| 2012/0285656 | A1 | 11/2012 | Moore | |
| 2014/0367067 | A1 | 12/2014 | Jain et al. | |
| 2016/0222761 | A1* | 8/2016 | Cain | E21B 43/017 |

FOREIGN PATENT DOCUMENTS

| | | | |
|---|---|---|---|
| WO | 2010110674 | A2 | 9/2010 |
| WO | 2013002644 | A1 | 1/2013 |
| WO | 2014049024 | A2 | 4/2014 |
| WO | 20160123340 | A1 | 8/2016 |

OTHER PUBLICATIONS

International Search Report and Written Opinion issued in International Patent Appl. No. PCT/EP2017/076793 dated Jan. 31, 2018; 18 pages.

* cited by examiner

*Primary Examiner* — Daniel P Stephenson
(74) *Attorney, Agent, or Firm* — Helene Raybaud

(57) ABSTRACT

An apparatus includes a subsea flow line and a two stage heat exchanger. The subsea flow line communicates a process flow that is associated with a subsea well, and the heat exchanger transfers thermal energy between the process flow and an ambient sea. The heat exchanger includes a primary circuit in communication with the flow line to transfer thermal energy with the process flow; and the heat exchanger includes a secondary circuit in thermal communication with the primary circuit to transfer thermal energy with the primary circuit.

17 Claims, 6 Drawing Sheets

REGULATING THE TEMPERATURE OF A SUBSEA PROCESS FLOW

CROSS REFERENCE TO RELATED APPLICATION

The present document is based on and claims priority to U.S. Provisional Application Ser. No. 62/410,144, filed Oct. 19, 2016, which is incorporated herein by reference in its entirety.

BACKGROUND

In a subsea oil and gas production system, it is often desirable to perform certain fluid processing activities on or near the seabed. The flow (called a "process flow" herein) that is processed in subsea hydrocarbon production may be a multiphase flow that is extracted from an underground reservoir. In this manner, the process flow may be a mixture of oil, gas, water, and/or solid matter. A processing station might be arranged on the seabed and configured to transport the process flow from the reservoir to a sea surface-based or land-based host facility. For this purpose, the processing station may include fluid pumps (single phase and/or multiphase pumps) and/or compressors (gas compressors and/or "wet gas" compressors).

There may be benefits to controlling the temperature of the process flow, as a flow temperature that is too low or high may adversely affect the components (pumps, compressors, flow lines, and so forth) of the production system. In this manner, if the temperature of the process flow is too high, the high temperature might cause such adverse effects as increasing external scale formation (fouling) due to the presence of inverse soluble salts, introducing material-related issues, reducing the operational envelopes of pumps, and so forth. If the temperature of the process fluid is too low, the low temperature might cause such adverse effects as hydrate formation, waxing, water condensation, higher process flow viscosity, stronger emulsions, higher pressure losses, and so forth.

SUMMARY

In accordance with an example implementation, an apparatus includes a subsea flow line; and a two stage heat exchanger. The subsea flow line communicates a process flow that is associated with a subsea well, and the heat exchanger transfers thermal energy between the process flow and an ambient sea. The heat exchanger includes a primary circuit in communication with the flow line to transfer thermal energy with the process flow; and the heat exchanger includes a secondary circuit in thermal communication with the primary circuit to transfer thermal energy with the primary circuit.

In accordance with another example implementation, an apparatus includes a plurality of two stage heat exchangers to be deployed on a seafloor. The apparatus includes a plurality of valves to selectively connect the heat exchanger assemblies together to configure a thermal exchange capacity to be applied to a process flow that is associated with a subsea well.

In accordance with another example implementation, a system includes a subsea flow line and a seabed-disposed cooler assembly. The cooler assembly includes a primary cooling stage that includes an inlet coupled to the subsea flow line to receive the process flow and an outlet to provide a second cool to process flow. The cooler assembly includes a secondary cooling stage in thermal communication with the primary cooling stage. The system further includes a seabed-disposed processing station that includes an inlet coupled to the outlet of the primary cooling stage to receive cooled process flow.

In accordance with yet another example implementation, a technique includes communicating a process flow associated with a subsea well through a first heat exchanger; using a second heat exchanger thermally coupled to the first heat exchanger to exchange thermal energy with the first heat exchanger; and transferring thermal energy from the second heat exchanger with an ambient sea.

Advantages and other features will become apparent from the following drawings, description and claims.

DETAILED DESCRIPTION

Figure 1:
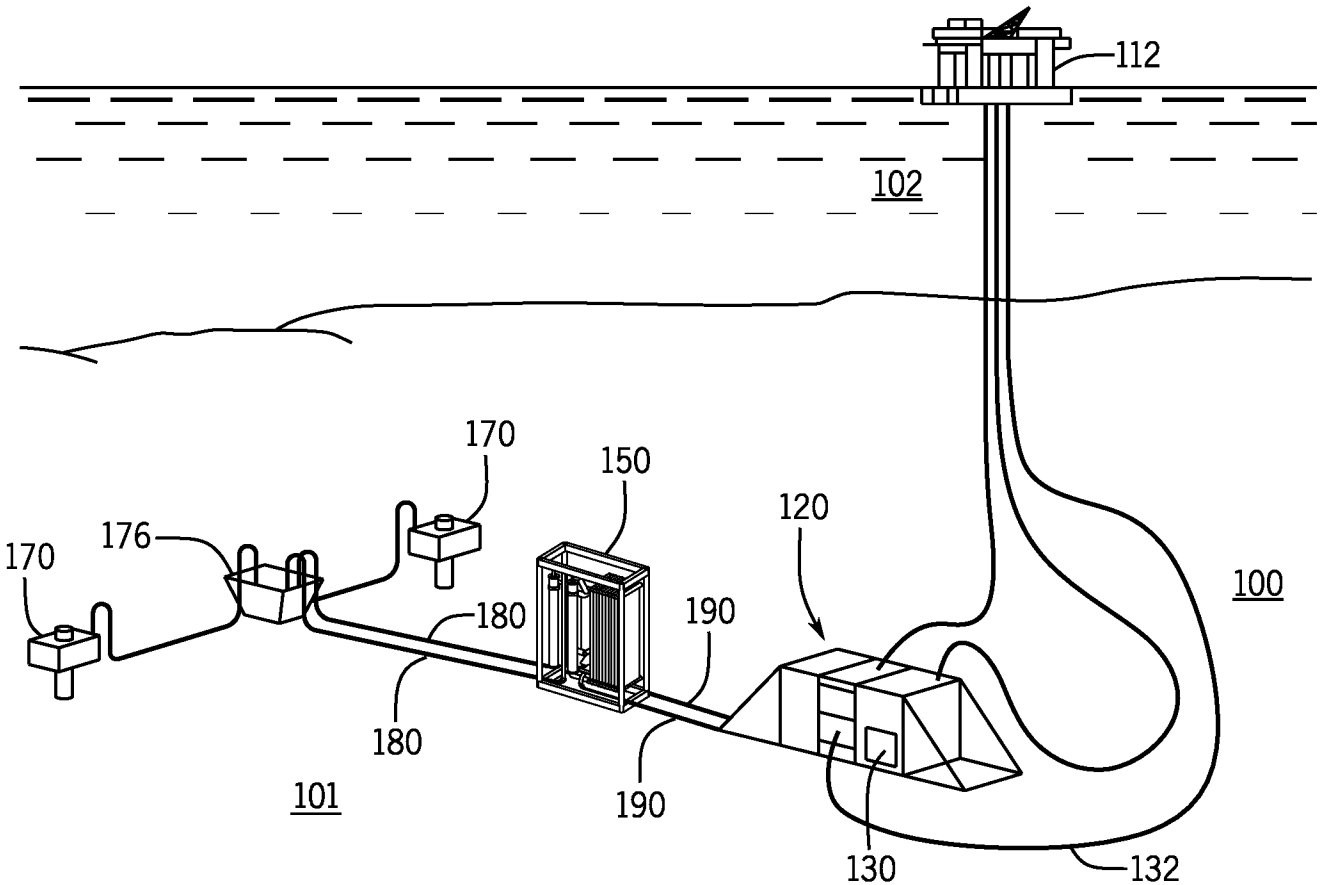
FIG. 1 is a schematic diagram of a subsea hydrocarbon fluid-based production system according to an example implementation.

In the drawings and description that follow, like parts are typically marked throughout the specification and drawings with the same reference numerals. The drawing figures are not necessarily to scale. Certain features of the disclosed implementations may be shown exaggerated in scale or in somewhat schematic form and some details of conventional elements may not be shown in the interest of clarity and conciseness. The present disclosure is susceptible to implementations of different forms. Specific implementations are described in detail and are shown in the drawings, with the understanding that the present disclosure is to be considered an exemplification of the principles of the disclosure, and is not intended to limit the disclosure to that illustrated and described herein. It is to be fully recognized that the different teachings of the implementations discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to." Any use of any form of the terms "connect," "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the implementations, and by referring to the accompanying drawings.

One way to cool the temperature of a process flow that is associated with a subsea well is to route the process fluid though a seabed-disposed single stage cooling assembly (a cooling assembly that rests on the seabed, for example). In this manner, the process flow may be a multiphase production flow that is produced from a hydrocarbon-bearing subterranean reservoir, and the single stage cooling assembly may be disposed upstream or downstream from a subsea-bed disposed processing system (a system that performs such functions as pumping the process flow, applying dense phase pumping or compression, performing dense phase compression for gas injection, and so forth). The process flow may be communicated from the reservoir and into the single stage cooler assembly, where forced convection is used for the process flow, and forced convection is used for the other side to transfer thermal energy from the process flow to the ambient sea environment. This approach, however, may face challenges for relatively high cooling loads, and as such, the single stage cooling assembly may become less suitable for higher temperature and higher pressure process flows. It is noted that high cooling loads may be caused by a high flow rate even at low pressure and temperature.

Moreover, the single stage cooler assembly may be constructed from steel to withstand the pressure difference between the ambient sea and the process flow. Using non-coated steel in seawater may not be feasible for relatively high surface temperature applications because scale deposits from inverse soluble salts may rapidly foul up the cooler assembly's external sea-exposed surface. Painting this surface may not be a feasible mitigation, as the paint may act as a foulant and increase the required surface area by a significant amount (by fifty percent, for example). Moreover, the combination of high temperature and high pressure, along with the seawater may cause the cooler assembly to be susceptible to such adverse effects as hydrogen induced stress cracking (HISC) and other types of corrosion, if specific materials and/or coating systems are not used. Such materials and/or coating systems may be detrimental to heat exchange performance.

In accordance with example implementations that are described herein, the temperature of a process flow that is associated with a subsea well is regulated using a seabed-disposed, two stage heat exchanger assembly. As an example, the process flow may contain one or more of the following: oil, gas, water and solids. Moreover, the process flow may contain additives, such as emulsion breakers, hydrate inhibitors, biocides, and so forth. As described herein, the use of the two stage heat exchanger assembly may have many benefits over a single stage heat exchanger.

Referring to FIG. 1, as a more specific example, in accordance with some implementations, a subsea well system 100 includes a two stage, heat exchanger assembly for purposes of transferring thermal energy between a process flow and the ambient sea environment to regulate a temperature of the process flow. It is noted that this thermal transfer may include cooling the process flow, as well as heating the process flow, if the process flow is colder than the ambient water. For purposes of simplifying the following description, the two stage heat exchanger assembly is described as being used to cool the process flow, i.e., transfer thermal energy from the process flow to the ambient sea. As such, "cooler assemblies" are described below. However, the two stage heat exchanger assemblies that are described herein may be used to transfer thermal energy from the ambient sea to the process flow and thus, may be used to heat the process flow, in accordance with further example implementations.

For the example implementation of FIG. 1, the well system 100 includes a two stage, subsea cooler assembly 150 for purposes of cooling the temperature of a process flow that is associated with a subterranean hydrocarbon-bearing reservoir. The subsea cooler assembly 150 is disposed on the seabed 101. For the example implementation that is depicted in FIG. 1, the process flow may be a multiphase mixture of fluids produced from the hydrocarbon bearing reservoir via one or multiple wells. In this manner, FIG. 1 depicts subsea wellheads 170 being connected to a seabed-disposed manifold 176; and one or multiple pipelines, or flow lines 180, may communicate the process flow from the manifold 176 to the cooler assembly 150.

Moreover, for the example implementation of FIG. 1, the process flow is communicated to a seabed-disposed processing station 120. The processing station 120 may be, for examples, a station containing pumps and/or compressors, for purposes of transporting the process flow to a sea surface platform 112. Moreover, the processing station 120 may be associated with other functions, such as, for example dense phase pumping or compression (for dense phase gas injection, for example) and even regulating the temperature of the process flow, as described herein. In accordance with example implementations, the processing station 120 may be constructed to perform one or multiple functions that are directed to the process flow, such as flow pumping, flow compressing and/or phase separation. For the implementations that are described herein, it is understood that the references to the subsea compressors and compressor modules may alternatively refer to subsea pump and pumping modules. Moreover, references herein to subsea compressors and subsea pumps are to be understood to refer equally to subsea compressors and pumps for single phase liquids, single phase gases, or multiphase fluids.

In general, the processing station 120 may include a process flow processing module 130, which may be powered by one or more electric motors, such as induction motors or permanent magnet motors. In accordance with example implementations, the processing module 130 may include a rotating machine, such as a compressor and/or a pump.

In accordance with example implementations, flows are communicated from the processing station 120 and the sea surface platform 112 using one or multiple flow lines 132 that extend from the seabed 101 through seawater 102 to the sea surface platform 112. In addition to flows being communicated between the sea surface platform 112 and the processing station 120, one or multiple umbilicals may be used to supply barrier fluids and other fluids, as well as convey control and data lines that may be used by equipment of the processing station 120 and possibly equipment of the cooler assembly 150.

Although FIG. 1 depicts the sea surface platform 112, the flow lines 132 and umbilicals may be run from some other surface facility, such as a floating production, storage and offloading (FPSO) unit or a shore-based facility. Moreover, depending on the particular implementation, the environment may be in relatively deep water depth or in relatively shallow water where significant marine growth may occur. As described herein, the cooler assembly 150 may have features that inhibit such significant marine growth. For example, as described herein, the ambient sea surface of the cooler assembly 150 may be coated with a paint to inhibit marine growth. Moreover, the cooler assembly 150 may be more tolerant of marine growth if it does occur (as compared to a single stage cooler assembly, for example), as the speed of a coolant pump of the cooler assembly 150 may be increased for purposes of increasing the coolant velocity.

In accordance with some implementations, the subsea well system 100 may include an electrical submersible pump (ESP), which may either be located downhole in a well or in a subsea location, such as on the seafloor, in a Christmas tree, at the wellhead 170, or at any other location on a flow line. Moreover, the subsea well system 100 may include a gas lift subsystem. In accordance with further example implementations, the subsea well system 100 may not include the processing station 120.

For the specific implementation that is depicted in FIG. 1, the subsea cooler assembly 150 is located upstream of the processing station 120 for purposes of cooling the process flow after the flow exits the reservoir and before the flow enters the processing station 120. Thus, for the example implementation of FIG. 1, the subsea cooler assembly 150 receives a relatively higher temperature process flow from the reservoir via one or multiple input flow lines 180 and correspondingly provides a relatively lower temperature output flow via one or multiple output flow lines 190 to the processing station 120. As described herein, in accordance with further example implementations, the cooler assembly 150 may be integrated with the processing station 120. In accordance with further example implementations, the subsea cooler assembly 150 may be located downstream of the processing station 120.

Figure 2:
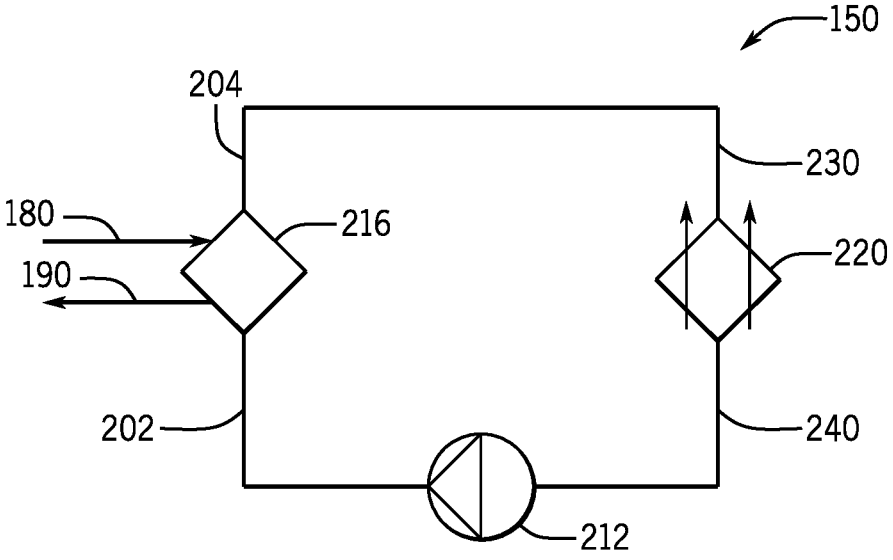
FIG. 2 is a schematic diagram of a subsea cooler assembly of the production system of FIG. 1 used to regulate the temperature of a process flow according to an example implementation.

FIG. 2 is a schematic diagram of the cooler assembly 150, in accordance with example implementations. In general, the cooler assembly 150 includes a forced convection, primary cooling stage, or circuit. The primary cooling circuit includes a process heat exchanger (called a "process cooler 216" herein) that transfers thermal energy from the process flow (received from the input flow line 180) to produce a cooled process flow that is provided to the output flow line 190. In accordance with example implementations, the process flow is communicated through the process cooler 216 in a downward direction between the inlet 181 and the outlet 191. The downward direction of the process flow in the process cooler 216 allows sediment to be easily removed from the process cooler 216 (due to gravity and the flow direction) and thus, not accumulate in the process cooler 216.

The cooler assembly 150 also includes a secondary cooling stage, or circuit, which includes a secondary heat exchanger (called a "secondary cooler 220" herein). In accordance with example implementations, in addition to the secondary cooler 220, the secondary cooling circuit includes a coolant pump 212, which circulates a coolant (glycol or another coolant, for example) in a closed coolant circulation path that extends through the secondary cooler 220 and the process cooler 216. This closed coolant circulation path transfers thermal energy from the process cooler 216 to the secondary cooler 220. Thermal energy from the secondary cooler 220, in turn, is transferred to the ambient sea. In this manner, the coolant exits the outlet of the coolant pump 212 and enters an inlet 202 of the process cooler 216; exits an outlet 204 of the process cooler 216 to enter an inlet 230 of the free convention cooler 220 and exits an outlet 240 of the free convention cooler 220 to return to an inlet of the coolant pump 212. The secondary circuit of the cooler assembly 150 therefore serves as an intermediate stage between the process cooler 216 and the ambient sea environment. Forced convection occurs on the coolant side of the secondary cooler 220, and free convection on the sea-exposed side of the secondary cooler 220 transfers thermal energy from the secondary cooler 220 to the ambient sea.

FIG. 2 depicts a countercurrent flow of the coolant with respect to the process flow. In accordance with further example implementations, the coolant may be arranged to flow as a cross flow with respect to the process flow.

In accordance with some implementations, the process cooler 216 may be placed in a protected environment (an environment in which the process cooler 216 is protected by a coolant, for example), which allows a material that has a relatively high thermal conductivity to be used for the process cooler 216, without a coating or other protection that might reduce the performance of the cooler assembly 150.

The use of the secondary circuit allows forced convection on the external side of the relatively high pressure, process cooler 216. This allows improved heat transfer (as opposed to a single stage cooler assembly) and hence, allows a reduction in size of the process cooler 216 (as compared to a single stage cooler assembly). Moreover, the secondary circuit may be made at a relatively low cost due to the low pressure design of the circuit, as further described herein.

In accordance with example implementations, the coolant pump 212 may be submerged in the coolant of the secondary circuit.

In accordance with example implementations, the secondary circuit may be pressure compensated so that the coolant in the secondary circuit has a pressure at or near the pressure of the ambient seawater. Accordingly, due to the relatively low pressure differential acting on wall of the secondary cooler 220, the cooler 220 may be constructed using relatively thin-walled and low cost materials (thin, tube sheeting, for example). Moreover, the secondary cooler 220 may be constructed from a material, such as carbon steel, that has a relatively high thermal conductivity. The secondary cooler 220 may accordingly be made with a relatively large area margin and may be relatively easy to clean. Moreover, a coating, such as paint, may be used on the surface of the secondary cooler 220, without raising concerns of fouling (as may occur with a single stage cooler assembly).

In accordance with some implementations, the secondary cooler 220 may be a plate-type heat exchanger. In this manner, in accordance with example implementations, the secondary cooler 220 may include two plates that are mated together (pressed together with a seal or gasket in between, for example). The mating flow plates have corresponding flow channels, which circulate the coolant of the secondary circuit 202, and the seawater contacts the external side of each of these flow plates, thereby providing a relatively large surface area (i.e., the plates act as internal and external cooling fins) and allowing for relatively easy cleaning of the seaside surface.

As described herein, the secondary cooler 220 may not be formed from flow plates, in accordance with further example implementations.

Referring back to FIG. 1, for the depicted example implementation, the subsea cooler assembly 150 is disposed upstream of the processing station 120 and is depicted as being separate from the processing station 120. However, in accordance with further example implementations, the cooler assembly 150 may be disposed in or in close proximity to the processing station 120. This arrangement, in turn, may allow components of the processing station 120 to be cooled by the cooler assembly 150. For example, in accordance with some implementations, the processing module 130 may include, for example, a circulation pump, and a motor of the circulation pump may be immersed inside the coolant fluid of the secondary cooling circuit. The secondary coolant fluid may serve as both a motor coolant and a bearing lubrication. Accordingly, there may be no need for high pressure motor housing or special sealing arrangements, thereby allowing standard, low cost pumps to be used. The coolant of the secondary cooling circuit may be used to cool and/or lubricate other components of the processing station 120, in accordance with further implementations.

In accordance with further implementations, the cooler assembly 150 may be located downstream from the processing station 120 to cool the process flow after the process flow leaves the processing station 120. In accordance with further example implementations, the subsea well system 100 may include multiple cooler assemblies 150, where one cooler assembly 150 is upstream of the processing station 120 to cool the process flow before the process flow enters the processing station 120, and another cooler assembly 150 is disposed downstream of the processing station 120 to cool the process flow after the process flow leaves the processing station 120. Moreover, in accordance with further example implementations, multiple cooler assemblies 150 may be connected together in series, in parallel and/or in a configuration of parallel connected cooler assemblies 150 and series connected cooler assemblies 150, as further described herein in connection with a cooler assembly 500 FIG. 5. Additionally, although implementations are described herein in which the cooler assembly 150 is located in the main flow path, in accordance with further example implementations, the cooler assembly 150 may be located in a recirculation flow path of the processing station 120. Moreover, in accordance with further example implementations, the cooler assembly 150 may be located in a bypass, or slip stream. This is discussed further below in connection with the cooler assembly 500 of FIG. 5.

Figure 3A:
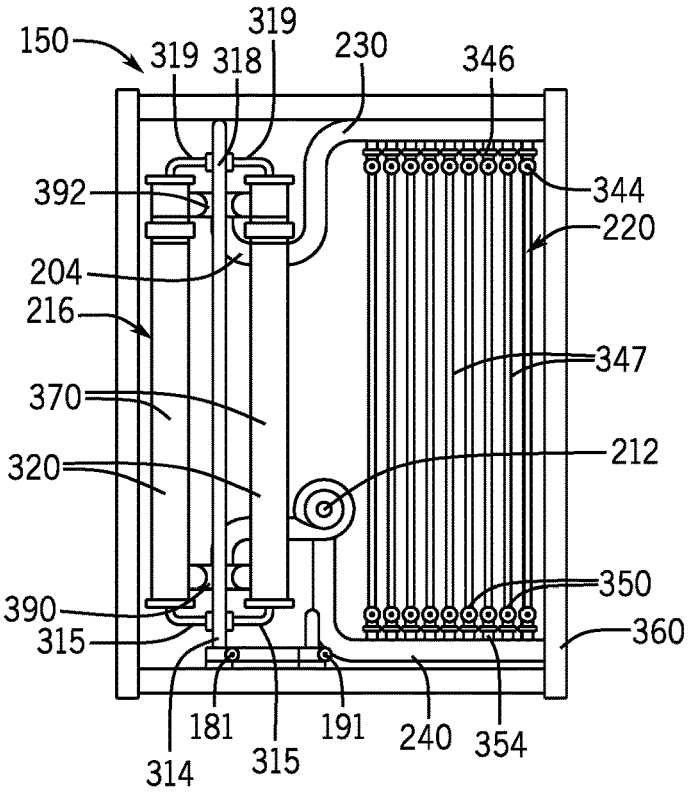
FIG. 3A is a side view of the subsea cooler assembly of FIG. 1 according to an example implementation.
Figure 3B:
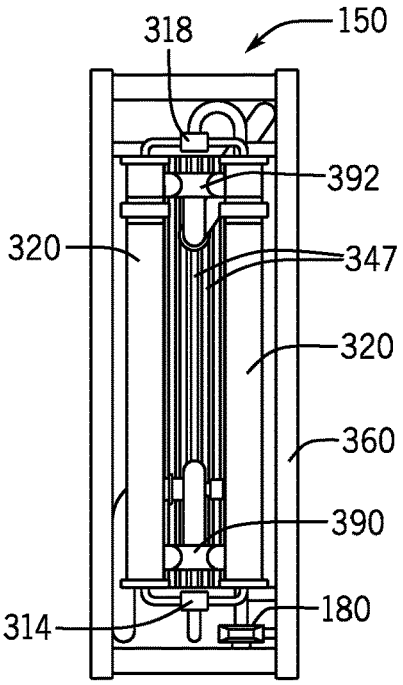
FIG. 3B is an end view of the subsea cooler assembly of FIG. 1 according to an example implementation.
Figure 3C:
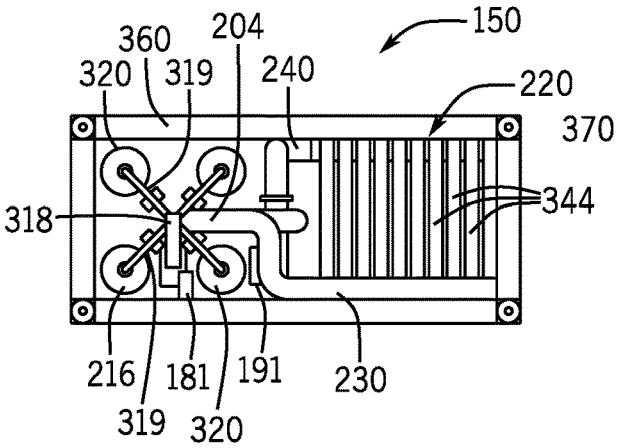
FIG. 3C is a top view of the subsea cooler assembly of FIG. 1 according to an example implementation.
Figure 3D:
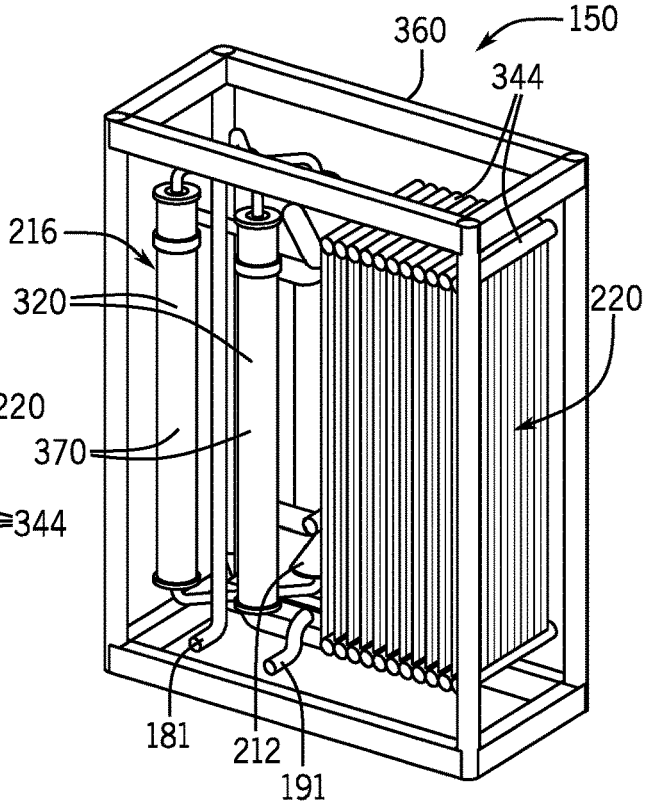
FIG. 3D is a perspective view of the subsea cooler assembly of FIG. 1 according to an example implementation.

FIGS. 3A, 3B, 3C and 3D depict side, end, top and perspective views of the cooler assembly 150, in accordance with example implementations. Referring to FIG. 3A, in general, the subsea cooler assembly 150 may be mounted on an externally exposed frame 360. The frame 360 may facilitate deployment of the cooler assembly 150 and the possible retrieval of the cooler assembly 150 from the seabed (via a crane, for example). Referring to FIGS. 3A and 3D, the process cooler 216 includes an inlet connector 181 to receive the process flow from the line 180 and an outlet connector 191 to provide the cooled process flow to the line 190.

The inlet connector 181 routes the received process flow to a distribution manifold 318 that, in turn, routes the process flow to distribution pipes 319 for purposes of distributing the process flow to the top ends of vertical cooling towers 320 (four vertical cooling towers 320 being depicted in the example implementation) that are each shared by the process cooler 216 and the secondary circuit of the cooler assembly 150.

Inside the cooling towers 320, heat transfer occurs between the process cooler 216 and the coolant of the secondary circuit. As depicted in FIG. 3A, in accordance with example implementations, the cooling tower 320 includes an outer tube 370 that defines an internal space inside the tube 370. Coolant of the secondary circuit is contained inside this internal space along with vertically extending pipes of the process cooler 216. In this manner, the vertically extending pipes of the process cooler 216 contain passageways that communicate the process flow, and these pipes, in turn, are surrounded by the coolant of the secondary circuit. As such, thermal energy is transferred between the process flow and the coolant of the secondary circuit. The process flow exits the cooling towers 320 via collection pipes 315 and enters a collector manifold 314 that routes the process flow into the process flow outlet 191.

In accordance with example implementations, the cooling towers 320 may be modular units so that the cooler assembly 150 may be designed with a particular number of parallel units (four shown as an example in FIGS. 3A, 3B, 3C and 3D), depending the cooling capacity criteria and how the total system is modularized.

For the secondary circuit of the cooler assembly 150, the inlet 230 of the secondary cooler 220 receives the coolant from a collector manifold 392, which, in turn, receives the coolant from the cooling towers 320. The coolant received by the collector manifold 392 is communicated to a distribution manifold 346 of the secondary cooler 220, and distribution pipes 344 distribute the coolant from the distribution manifold 346 into vertical cooling pipes 347 of the secondary cooler 220. Thus, via the cooling pipes 347, thermal energy is transferred to the ambient sea. Coolant from the pipes 347 returns (via collection pipes 350) to a collector manifold 354 that, in turn, communicates the coolant to the cooler outlet 240 (and to the inlet of the coolant pump 212). The coolant from the outlet of the coolant pump 212 enters a distribution manifold 390 that provides the coolant to the cooling towers 320.

In accordance with further example implementations, the coolant may circulate in the opposite direction to that described above.

Figure 4:
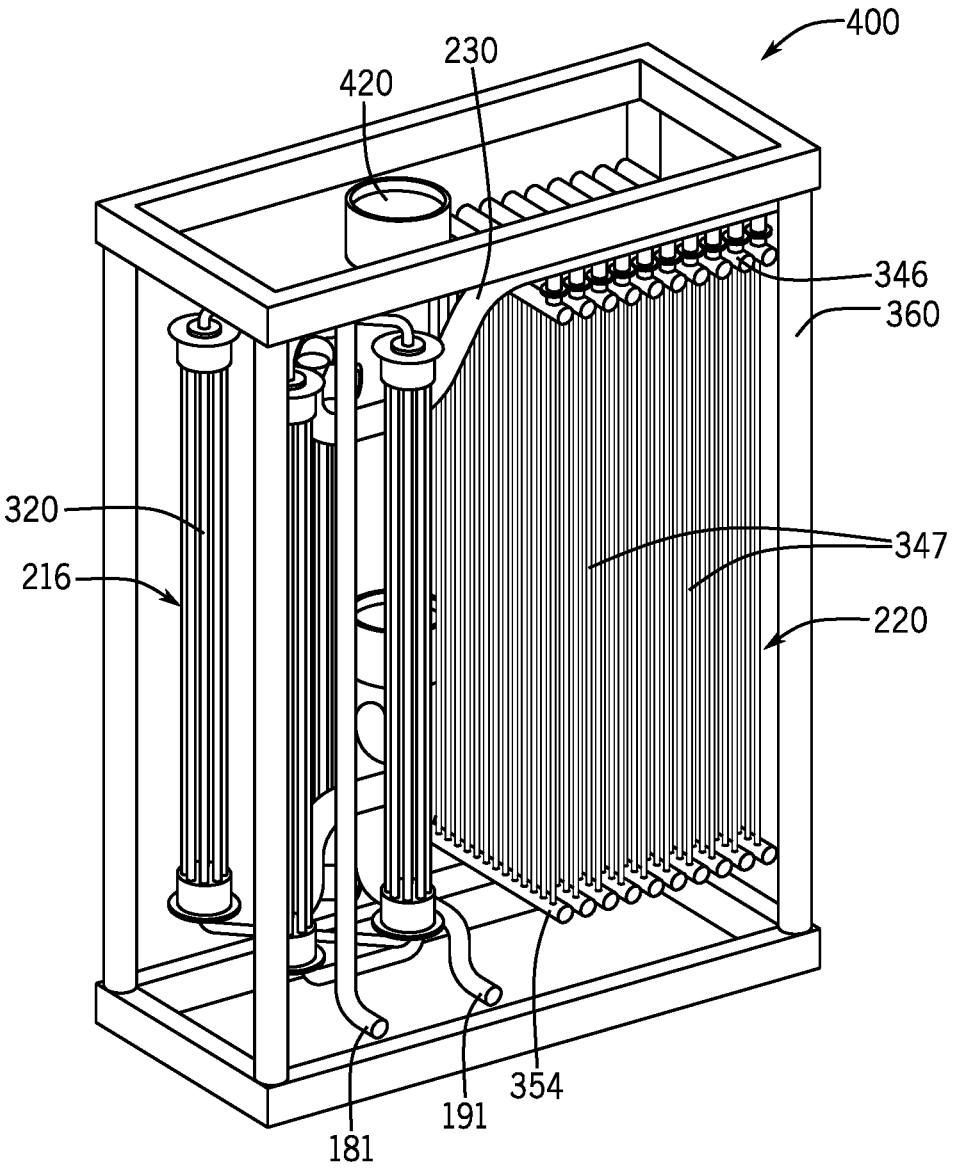
FIG. 4 is a perspective view of a subsea cooler assembly according to a further example implementation.
Figure 6:
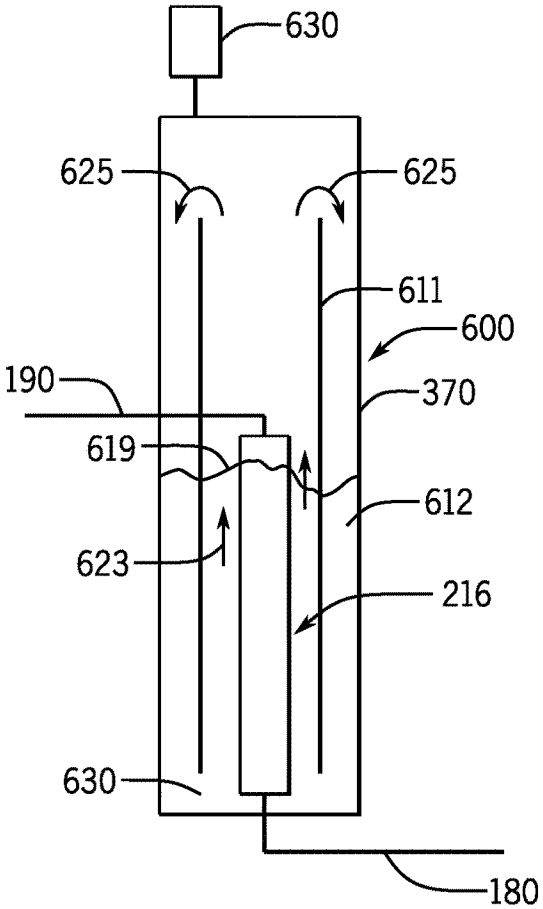
FIG. 6 is a schematic diagram of a cooling tower that removes thermal energy by causing a liquid to boil and condensate according to a further example implementation.

Referring to FIG. 4, in accordance with some implementations, the cooler assembly 150 may be replaced with a cooler assembly 400. In general, the cooler assembly 400 has a similar design to the cooler assembly 150, with like reference numerals being used to denote similar components. It is noted that FIG. 4 depicts the cooling towers 320 with the outer tubes being removed (for illustration purposes), which allows viewing of the vertically extending pipes 402 of the process cooler 216. Unlike the cooler assembly 150, the cooler assembly 400 further includes a pressure regulator 420, part of the secondary circuit, for purposes of regulating the pressure of the secondary circuit so that the pressure is near or at the pressure of the ambient sea.

In accordance with example implementations, even though the cooler assembly 150 does not include a pressure regulator, the cooler assembly 150 may include a compensator volume to avoid over pressurization of the system.

Figure 5:
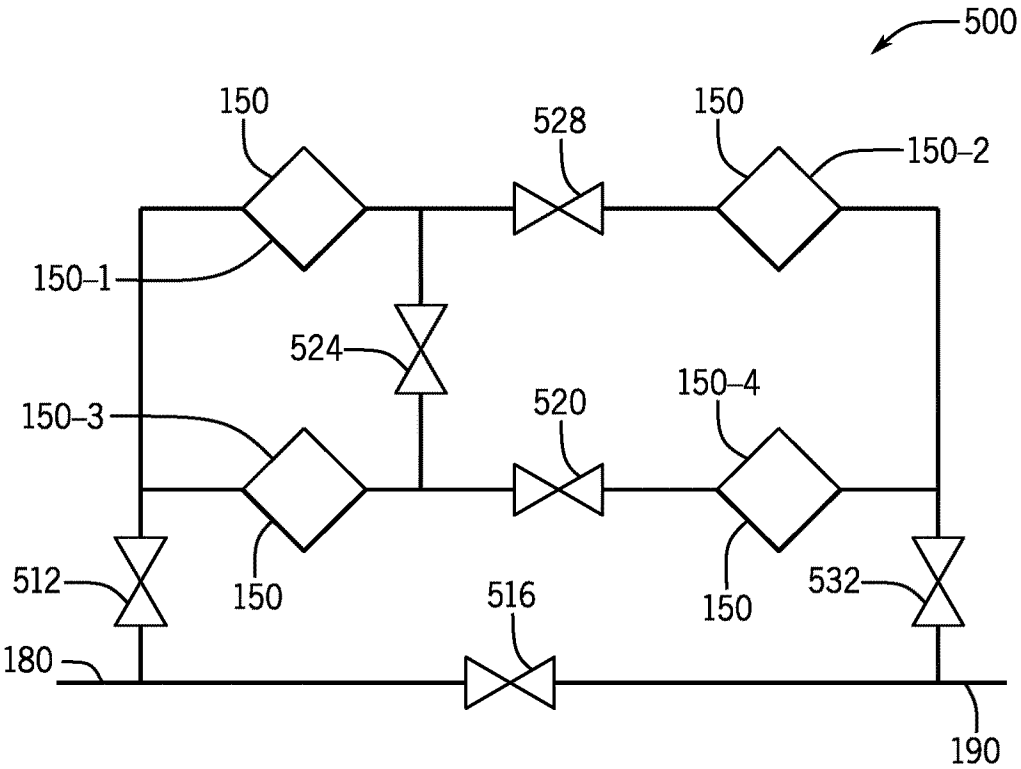
FIG. 5 is a schematic diagram of a subsea cooler assembly having an adjustable cooling capacity according to a further example implementation.

In accordance with further example implementations, a subsea cooler assembly 500 that is depicted in FIG. 5 may be used for purposes of providing an adjustable cooling capacity so that the cooling capacity may be adjusted according to field requirements. In this manner, cooling the process flow too much or too little may have adverse effects, as noted above. The appropriate cooling capacity may be determined based on, for example, pressure and temperature measurements of the process flow (acquired via pressure and temperature sensors disposed in the flow line 180, flow line 190 and/or in the processing station 120, for example). For example, the measurements may be used to determine an appropriate target discharge temperature for the cooler assembly 500 to place the process flow outside of the hydrate region of the hydrate curves, where hydrates may otherwise form. The cooling capacity may also be temporarily adjusted for other reasons, such as for example, to temporarily create a discharge temperature to melt wax deposits.

Referring to FIG. 5, in accordance with example implementations, the cooler assembly 500 includes multiple cooler assemblies 150 (four cooler assemblies 150-1, 150-2, 150-3 and 150-4, being depicted as examples in FIG. 5) that may be connected in series and/or in parallel, depending on the particular cooling capacity desired. In this regard, the cooler assembly 500 includes valves 512, 520, 524, 528 and 532, which may be controlled to, for example, connect the cooler assemblies 150-1 and 150-2 in series (by opening the valves 512, 528 and 532 and closing the valves 520 and 524); or connect the cooler assemblies 150-3 and 150-4 in series (by opening the valves 512, 520 and 532 and closing the valves 528 and 524). As another example, the series combination of the cooler assemblies 150-1 and 150-2 may be placed in parallel with the series combination of the cooler assemblies 150-3 and 150-4 (by opening the valves 512, 520, 528 and 532 and closing the valve 524). Other valve opening and closing combinations, as well as other valve locations, are possible to regulate the cooling capacity of the cooler assembly 500.

The cooler assembly 500 may also include, as depicted in FIG. 5, a pigging line valve 516 that is disposed between the inlet 180 and outlet 190 of the cooler 500. In this manner, for a pigging operation, the valve 516 may be opened, and the valves 512 and 532 may be closed. Otherwise, for normal operations, the valve 516 may be closed, and the valves 512 and 532 may be opened.

In accordance with example implementations, the valves 512 and 532 may be closed to allow replacement of a given cooler assembly 150 due to an upgrade or a replacement of a failed cooler assembly 150. Moreover, in accordance with example implementations, the valve 516 may be a choke valve that may be operated for purposes of regulating the capacity of the cooler assembly 500. In this manner, the extent to which the valve 516 is open may be used to route a bypass flow through the cooler assemblies 150 and as such, control the overall cooling capacity of the cooler assembly 500.

In accordance with further example implementations, the cooling capacity of any of the cooler assemblies 150, 400 and/or 500 may be controlled by changing the speed of a circulation pump of the processing station 120 (see FIG. 1). In this regard, in accordance with some implementations, a frequency converter may be controlled to correspondingly change the speed of a circulation pump of the processing station 120. Thus, for purposes of controlling the cooling capacity of the cooler assembly, the effective cooling area may be changed (via an arrangement such as the cooler assembly 500), or the speed of the coolant pump may be controlled.

In accordance with further example implementations, the cooling tower 320 (see FIG. 3A, for example) may be replaced by a cooling tower 600, which without forced circulation of a coolant. Accordingly, in accordance with some implementations, a cooler assembly may not include a coolant pump and as such, may not need electrical power to be communicated to the cooler assembly.

In accordance with example implementations, the secondary circuit may rely on liquid pool boiling and gravity-based settling of the resulting condensate. As a more specific example, the cooling tower 600 may include the outer tube 370 and a chamber 611 that is disposed inside the tube 370 and enhances coolant circulation over the process cooler 216. The process cooler 216 is immersed in a liquid 619 that is contained in the chamber 611.

The liquid 619 has a boiling point temperature, which is controlled by a pressure that is set by a pressure regulator 630. Thus, the pressure in the secondary cooling chamber 611 may be adjusted to correspondingly control the boiling point of the liquid 619. When the liquid boils, the boiling liquid travels upwardly (as depicted by arrow 623) and over the wall of the secondary cooling chamber 611 (as depicted at reference numeral 625) to condensate in an annulus 612 between the walls of the chambers 610 and 611, and, via gravity settling, return liquid back to the secondary cooling chamber 611 via lower openings 630 in wall of the chamber 611. In accordance with further example implementations, the liquid boiling may be used in combination with a circulation pump to avoid any issues that may be generated by gravity-based settling.

The cooling tower 600 may remove issues pertaining to external scale and fouling on the high pressure temperature side, while eliminating the need for power as the boiling point of the secondary circuit may be determined by pressure (via the pressure regulator 630). The cooling tower 600 may also mitigate, if not eliminate, the risk of overcooling, as heat transfer rates are reduced when the process temperature decreases below the boiling temperature for the liquid 619. Moreover, the cooling tower 600 allows adjusting the cooling capacity and process outlet temperature via pressure adjustments by the pressure regulator 630. As such, several flow assurance issues (hydrate formation, waxing, and so forth) may be eliminated if using a boiling point-based cooler.

In accordance with further example implementations, the vapor from the boiling of the coolant may be routed through a cooler, similar to the secondary cooler 220, for purposes of increasing free convection thermal exchange with the ambient sea.

Figure 7:
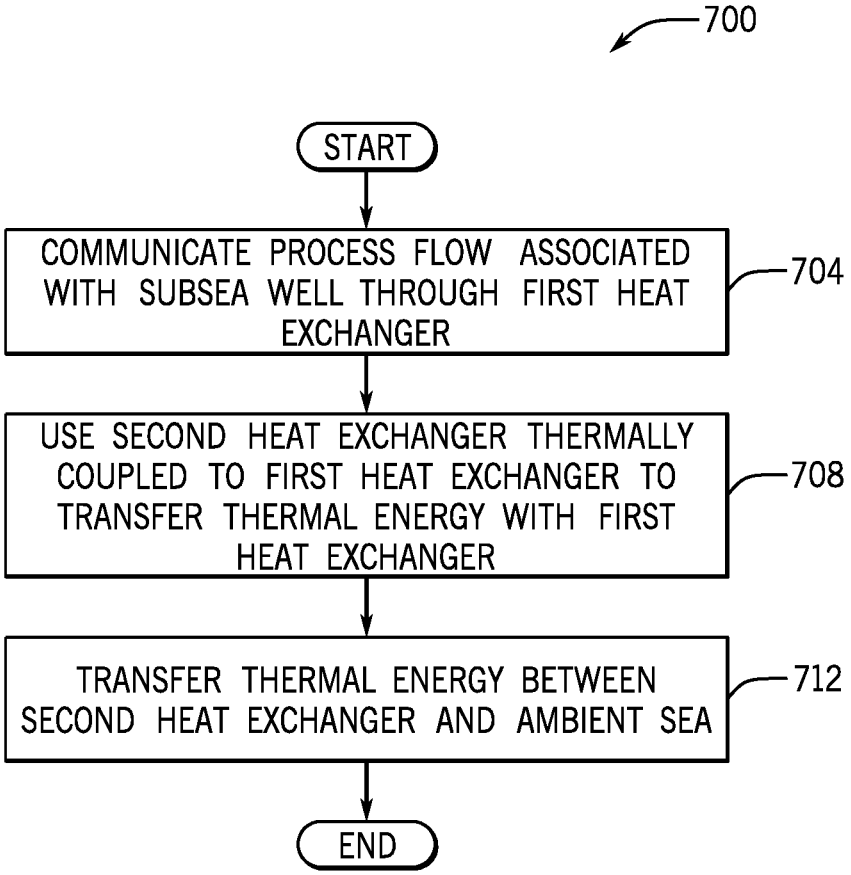
FIG. 7 is a flow diagram depicting a technique to regulate the temperature of a subsea process flow according to an example implementation.

Thus, referring to FIG. 7, in accordance with example implementations, a technique 700 includes communicating (block 704) a process flow associated with a subsea well through a first heat exchanger; and using (block 708) a second heat exchanger that is thermally coupled to the first heat exchanger to transfer thermal energy with the first heat exchanger. The technique 700 includes transferring (block 712) thermal energy between the second heat exchanger and the ambient sea.

The systems and techniques that are described herein may have one or more of the following advantages. Cheaper materials may be used. Easier welding procedures may be employed. The cooler assembly may have a reduced weight and/or a reduced size. The secondary circuit may be pressure compensated. Scaling issues may be eliminated for the free convection ambient sea surface, and the wall temperature for this surface may be reduced. Paint may be used on surfaces that are exposed to the sea. The free convection area on the secondary circuit on the process to coolant side may be increased using heat augmentation. Fouling compensation may be achieved by increasing the process pumping speed. The cooler assembly may provide reduced interventions, as the cleaning frequency may be decreased. The temperature of the process flow may be precisely controlled through speed control of the process fluid or the coolant. The temperature of the process flow may be controlled to inhibit the buildup of wax, hydrates, and so forth. There may be a longer cool down time (no touch time) due to increased thermal mass. The cooler assembly may be self-draining (i.e., no sediment or sand accumulation). The pressure drop across the subsea cooler may be reduced.

Other and different advantages may be achieved, in accordance with further implementations.

While the present disclosure has been described with respect to a limited number of implementations, those skilled in the art, having the benefit of this disclosure, will appreciate numerous modifications and variations therefrom. It is intended that the appended claims cover all such modifications and variations

What is claimed is:

1. An apparatus comprising:

a subsea flow line to communicate a process flow associated with a subsea well; and a two stage heat exchanger to transfer thermal energy between the process flow and a sea water, wherein the heat exchanger comprises:

a primary circuit in communication with the flow line, wherein the primary circuit comprises a first heat exchanger configured to transfer thermal energy between the process flow and a heat exchange fluid; and a secondary circuit in thermal communication with the primary circuit, wherein the secondary circuit comprises a second heat exchanger comprising a liquid to boil and condensate and configured to transfer thermal energy between the heat exchange fluid and the sea water, wherein the heat exchange fluid is different from the sea water.

2. The apparatus of claim 1, wherein the two stage heat exchanger comprises a fluid path through the first and second heat exchangers, the fluid path comprises the heat exchange fluid, the heat exchange fluid is isolated from the process flow in the first heat exchanger, and the heat exchange fluid is isolated from the sea water in the second heat exchanger.

3. The apparatus of claim 2, wherein the secondary circuit comprises a single phase pump to circulate the heat exchange fluid.

4. The apparatus of claim 1, wherein the heat exchange fluid has a reduced pressure relative to the process flow.

5. The apparatus of claim 1, wherein the heat exchange fluid comprises a glycol.

6. The apparatus of claim 1, wherein the primary cooling circuit has an associated first pressure differential between the process flow and the sea water surrounding the primary circuit, the secondary circuit has an associated second pressure differential between the heat exchange fluid of the secondary circuit and the sea water surrounding the secondary circuit, and the second pressure differential is less than the first pressure differential.

7. The apparatus of claim 1, wherein the first heat exchanger comprises a first vertical flow path of the process flow and a second vertical flow path of the heat exchange fluid.

8. An apparatus comprising:

a subsea flow line to communicate a process flow associated with a subsea well; and a two stage heat exchanger to transfer thermal energy between the process flow and a sea water, wherein the heat exchanger comprises:

a primary circuit in communication with the flow line, wherein the primary circuit comprises a first heat exchanger configured to transfer thermal energy between the process flow and a heat exchange fluid; and a secondary circuit in thermal communication with the primary circuit, wherein the secondary circuit comprises a second heat exchanger configured to transfer thermal energy between the heat exchange fluid and the sea water, wherein the heat exchange fluid is different from the sea water; and wherein the first heat exchanger comprises a plurality of pipes coupled to a distribution manifold and a collector manifold, wherein each of the plurality of pipes is surrounded by an outer tube to define a flow path of the heat exchange fluid along each of the plurality of pipes.

9. An apparatus comprising:

a plurality of two stage heat exchangers to be deployed on a sea floor; and a plurality of valves to selectively connect the plurality of heat exchangers together to configure a thermal exchange capacity to be applied to a process flow associated with a subsea well;

wherein the plurality of valves are adapted to be operated to selectively isolate one of the two stage heat exchangers from the remaining two stage heat exchangers.

10. The apparatus of claim 9, wherein the plurality of valves are adapted to be operated to chain multiples of the two stage heat exchangers together.

11. An apparatus comprising:

a plurality of two stage heat exchangers to be deployed on a sea floor; and a plurality of valves to selectively connect the plurality of heat exchangers together to configure a thermal exchange capacity to be applied to a process flow associated with a subsea well;

wherein, wherein the plurality of valves are adapted to be operated to selectively connect two of the two stage heat exchangers either in parallel or in series.

12. A system comprising:

a subsea flow line to communicate a process flow associated with a subsea well;

a seabed-disposed cooler assembly comprising:

a primary cooling stage comprising an inlet coupled to the subsea flow line to receive the process flow and an outlet to provide a second cooled process flow; and a secondary cooling stage in thermal communication with the primary cooling stage; and a seabed-disposed processing station comprising an inlet coupled to the outlet of the primary cooling stage to receive the cooled process flow;

wherein the system comprises at least one of:

the secondary cooling stage comprises a first pump to force circulate a coolant, the processing station comprises a second pump to circulate the fluid flow, and the second pump is immersed in the coolant; or the secondary cooling stage comprises a liquid to boil and condensate to remove thermal energy from the process flow.

13. The system of claim 12, wherein the processing station comprises a pump or a compressor in communication with the process flow.

14. The system of claim 12, wherein the secondary cooling stage comprises the first pump to force circulate the coolant, the processing station comprises the second pump to circulate the fluid flow, and the second pump is immersed in the coolant.

15. The system of claim 12, wherein the secondary cooling stage comprises the liquid to boil and the condensate to remove thermal energy from the process flow.

16. A method comprising:

transferring heat between a process flow and a heat exchange fluid in a first heat exchanger, wherein the process flow is associated with a subsea well; and transferring heat between the heat exchange fluid and a sea water in a second heat exchanger, wherein the heat exchange fluid is different from the sea water; and wherein a liquid contained in the second heat exchanger is boiled and condensed.

17. The method of claim 16, comprising force circulating the heat exchange fluid through the first heat exchanger and the second heat exchanger.

* * * * *